United States Patent [19]

Hanson et al.

[11] Patent Number: 4,793,758

[45] **Date of Patent: * Dec. 27, 1988**

[54] COVER FOR BINDING SHEETS

[75] Inventors: Gary R. Hanson, Minneapolis; Ray A. Hunder, Birchwood; George R. Rabuse, Sunfish Lake, all of Minn.

[73] Assignee: Minnesota Mining and Manufacturing Company, Saint Paul, Minn.

[ * ] Notice: The portion of the term of this patent subsequent to Jun. 16, 2004 has been disclaimed.

[21] Appl. No.: 864,530

[22] Filed: May 19, 1986

[51] Int. Cl.[4] ..... B42L 11/00

[52] U.S. Cl. ..... 412/4; 281/21 R; 281/29; 156/908

[58] Field of Search ..... 156/90, 227, 291, 486, 156/505, 908; 281/21 R, 29, 34, 35; 412/4, 6, 7, 8, 900, 901

[56] References Cited

U.S. PATENT DOCUMENTS

| | | | |
|---|---|---|---|
| 848,680 | 4/1907 | Nelson . | |
| 1,765,194 | 6/1930 | Von Auw . | |
| 1,913,969 | 6/1933 | Wood . | |
| 2,014,305 | 9/1935 | Alger . | |
| 2,455,971 | 12/1948 | Bosch | 412/27 X |
| 2,510,263 | 6/1950 | Stein | 129/19 |
| 3,088,754 | 5/1963 | Burgmer | 282/22 |
| 3,179,967 | 4/1965 | Yohn et al. | 11/1 |
| 3,188,114 | 6/1965 | O'Brien et al. | 281/21 |
| 3,206,225 | 9/1965 | Oleson | 281/29 |
| 3,210,093 | 10/1965 | Steidinger | 281/21 |
| 3,825,963 | 7/1974 | Abildgaard et al. | 11/1 |
| 3,833,244 | 9/1974 | Heimann | 281/21 |
| 3,995,886 | 12/1976 | Staats | 156/277 X |
| 4,007,950 | 2/1977 | Giulie | 281/25 |
| 4,106,148 | 8/1978 | Axelrod | 11/1 |
| 4,129,471 | 12/1978 | Rome | 156/277 X |
| 4,213,220 | 7/1980 | Lopez-Martinez | 11/1 |
| 4,266,812 | 5/1981 | Staats | 412/900 |
| 4,447,481 | 5/1984 | Holmberg | 428/40 |
| 4,511,298 | 4/1985 | Jones | 412/34 |
| 4,518,296 | 5/1985 | Pearson et al. | 412/37 |
| 4,558,888 | 12/1985 | Hanson et al. | 281/1 X |
| 4,562,102 | 12/1985 | Rabuse et al. | 156/90 X |
| 4,590,109 | 5/1986 | Holmberg | 428/40 |

FOREIGN PATENT DOCUMENTS

| | | | |
|---|---|---|---|
| 0110237 | 6/1984 | European Pat. Off. . | |
| 2815649 | 10/1979 | Fed. Rep. of Germany . | |
| 1382574 | 11/1964 | France | 281/21 R |
| 6711263 | 2/1969 | Netherlands | 281/21 R |

*Primary Examiner*—Paul A. Bell

*Attorney, Agent, or Firm*—Donald M. Sell; John C. Barnes

[57] ABSTRACT

A cover for the machine-less binding of pages into a booklet comprises a cover having a longitudinal edge of a strip of pressure sensitive tape adhered inside the cover along the central fold line to accept shingled edges of the pages.

11 Claims, 3 Drawing Sheets

COVER FOR BINDING SHEETS

BACKGROUND OF THE INVENTION

1. Field of the Invention

The present invention relates to a cover and process for the binding of a plurality of loose pages together and in one aspect to a cover having a strip of binding adhesive tape adhered to the cover to attach pages together along shingled edges of the pages to the cover.

2. Description of the Prior Art

The binding cover of the present invention is adapted to replace various binding systems for a plurality of, e.g. up to 25 pages. Prior binding systems for a small number of pages comprised staples, loose-leaf binders, mechanical fasteners, i.e., paper clips, prongs and fasteners as sold by Acco International Inc., Chicago, Ill. 60630, paper fasteners and washers as sold by Swingline, Inc., Long Island City, N.Y. 11101, plastic rivets, pins, slide strip binders and other jackets with built-in prongs for retaining perforated sheets. Binding by the use of preformed covers having a hot melt adhesive requiring a mechanism or tool for effecting the binding operation is not considered relevant. The shingling of sheets to expose a marginal portion of each sheet and binding them together by the use of adhesive contacting the edge of each sheet is known in the prior art. Such binding methods are taught by U.S. Pat. Nos. 1,765,194 and 2,455,971.

The assignee of this application has several applications copending for similar binding products incorporating pressure-sensitive adhesive for use in binding sheet together, and U.S. Pat. Nos. 4,518,296, 4,558,888 and 4,562,102 directed to an apparatus for use in binding sheets together with the adjacent edges shingled.

The essential difference between the present invention and the prior art is that it may be utilized to bind a plurality of sheets or papers together without the use of tools, fixtures, machines, electrical power, or lapsed time for heating or cooling the adhesive. The cover consists of a backing divided into a front and back portion with a strip of pressure-sensitive adhesive tape along the dividing line and a release material is provided to protect the adhesive prior to the binding operation.

The plurality of pages bound together by this binding cover reduces required storage space, allows stacking and the lay-flat feature provides for easy copying, reading, handling and page butting.

SUMMARY OF THE INVENTION

The present invention is directed to a backing for binding sheets together, which backing is formed of cover card stock creased by a fold line to form a front and back portion. The back portion has a length which is at least equal to the length of the paper to be bound plus some marginal dimension if desired, and a width corresponding to the width of the paper to be bound plus the width of the shingle of each page plus an additional width. A length of adhesive tape is attached along one marginal longitudinal edge to the front portion of the cover adjacent the fold line and spaced by a slight distance. The front portion can have dimensions equal to the back portion or the front portion could be reduced to a flap with a width which will extend sufficiently to allow a separate front cover, which has dimensions corresponding to the pages being bound, to be attached by a narrow band of a pressure-sensitive adhesive coated along the free edge of the flap.

The strip of binding adhesive tape and the band of adhesive for alternatively attaching a front cover are each protected initially by a strip of a release material (such as a liner) which will allow for the easy exposure of the remaining adhesive on the binding tape strip as needed for binding and of the band of adhesive for attaching a cover or backing to the flap.

DESCRIPTION OF THE DRAWING

The present invention will be further described with reference to the accompanying drawing wherein.

DESCRIPTION OF THE PREFERRED EMBODIMENTS

Figure 1:
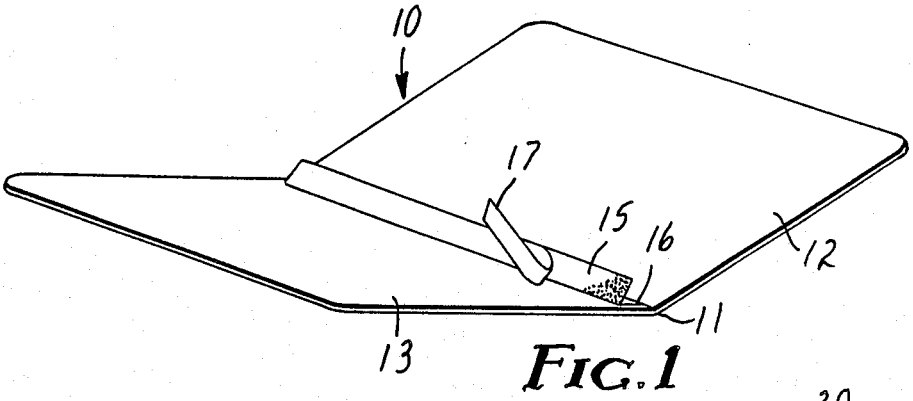
FIG. 1 is a perspective view of a cover according to the present invention.

Referring now to FIG. 1, the cover of the present invention as illustrated in FIG. 1 comprises a sheet 10 of cover stock which may be a paper composition having a caliper of about 0.009 inch and a basis weight of pounds (ream size 20×26), which sheet has been formed with a central flexible fold line 11 to define the back portion 12 to the front portion 13 of substantially the same dimensions. The binding tape has a flexural rigidity of between 0.0001 and 0.002 inch pounds, thus providing a binding which is supple yet has a stiffness sufficient to allow easy handling during the binding process and give the bound document security in use. The central fold line must not be so stiff as not to allow easy closure of the cover, therefore it should have a flexural rigidity of less than 0.03 inch pounds. It may be preferred to keep the entire cover backing within this limit. The stiffness or flexural rigidity is determined by the Technical Association of the Pulp and Paper Industry (TAPPI) Useful Methods test 409.

A strip of a pressure-sensitive adhesive tape 15 has a longitudinal edge portion 16 attached to the front portion 13 adjacent to the central fold score line 11. The attached portion of adhesive tape may extend slightly across this fold line to the back portion 12. The free edge or balance of the tape strip 15 is covered by a release material (such as a liner) 17. Surprisingly, it was found that the tape must extend along the front portion by at least a slight margin or some bound pages would later become detached. The tape adhesive on the tape 15 is a very tacky pressure-sensitive adhesive which in use is in contact with the shingled edges of the sheets to be bound therein. Stresses can occur during the final stages of the binding process which will cause the shingled edges to move. Therefore, the adhesive must have good Quick Stick qualities to allow the pages to stay attached after the initial adhesive contact with minimal pressure and dwell time. In actual use, adhesives with Quick Stick values (see page 7) less than 6 ounces per ½ inch do not work satisfactorily, and values greater than 10 ounces per ½ inch are preferred. Final adhesion of the pages of the bound document must be high enough that normal handling cannot cause pages to detach.

Proper binding adhesions for the adhesives and tapes are found using an 180° shear add 45° peel booklet tests as explained below.

Figure 2:
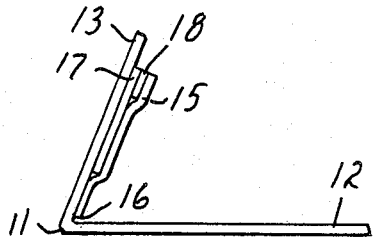
FIG. 2 is an enlarged fragmentary side view of an alternative construction.

The back 12 and front portion 13 of the cover have a length which is dependent on the length of the paper to be bound and is at least equal to the length of the paper to be bound but may be provided with an additional marginal dimension of, for example, 0.25 inch. The width of the back and front portions corresponds to the width of the loose pages to be bound plus the width of the page shingle times the number of pages to be bound, plus the width of the edge portion 16, and any additional marginal dimension of, for example, 0.25 inch. The minimum width of the binding adhesive tape is determined by the maximum number of pages to be bound in the cover times the paper thickness times Pi($\pi$) plus the width of the edge portion 16 of the tape 15 attached to the cover portion 13 plus the width of the tape at the face edge which overlaps onto the shingled sheets 30. This minimum width (W) of the tape strip can be reduced to the formula:

$$W=\pi t(N_{max}+5)$$

wherein: t equals the page thickness and $N_{max}$ equals the maximum number of pages to be bound. A portion of the overlap width could have a non-removable tab 18 possibly coated with a Post-It$^R$ adhesive on the surface away from the adhesive coated surface of tape 15, see FIG. 2, (double coated tape Y9415 made by 3M, St. Paul, MN 55144) to allow easier page debinding. Debinding could then be afforded by initially peeling the edge of the tape 15 having the tab 18 from the top sheet and progressively peeling the tape from the sheets. Wider tape widths result in more adhesive overlap on the front page. Multiple tape strips may be used to bind additional page sets in the same document. They would each constitute an additional strip of tape 15 facing the same direction overlaying the existing strip 15 with the edge portions 16 aligned, as shown in FIG. 3.

Figure 3:
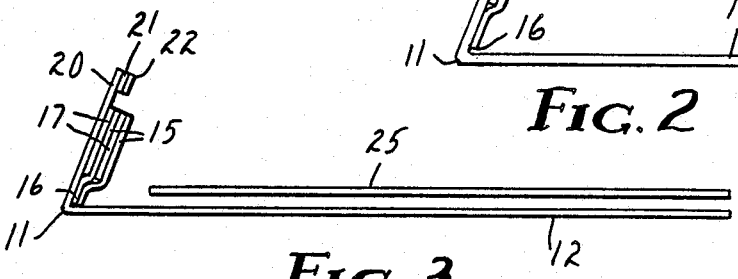
FIG. 3 is a side view of an alternative construction showing the back covers a front flap and separate front cover showing a view of the adhesive tape and adhesive coating and release liners.

The alternate construction FIG. 3, has the front portion reduced to a flap 20 which is folded at the score line 11', and the free edge thereof has a band of pressure-sensitive adhesive 21 coated on the inside surface, which adhesive is protected by a release liner 22. The reduced front portion 20 has a width which will extend sufficiently to allow a separate front cover 25 to be attached by the narrow band of a pressure-sensitive adhesive 21 coated along the free edge of the flap. The separate front cover 25 has dimensions similar to the pages being bound. The cover 25 is aligned with the back portion 12 and is attached to the flap 20.

Figure 5:
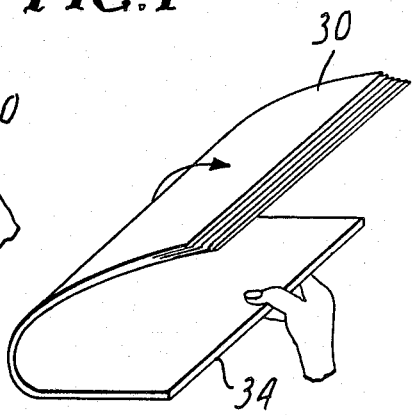
FIG. 5 is a perspective view illustrating another step of the binding process.

The covers are preferably made for use in binding a maximum of 25 sheets of paper. The dimensions of the cover and tape can be determined as folloss where "L" means length, "W" the width:

$L_{cover}=L_{pages}+(\text{margins}\times 2)$ $W_{cover}=W_{pages}+W_{shingle}+W_{space}+\text{margin}$ $W_{tape}=W_{shingle}+W_{overlap}+W_{attached}$ $L_{tape}=L_{pages}$ $W_{shingle}=2\pi N_{max}t_{page}x°/360°$ $W_{attached}=\pi t_{page}$ $W_{overlap}=3\pi t_{page}$ where:

$t_{page}$=the page thickness $N_{max.}$=the maximum number of pages x°=the degrees of wrap of the pages in performing the step illustrated in FIG. 5. For this method x° is approximately 180°.

EXAMPLE 1

For binding 25 standard 0.005 inch, 8.5×11 inch pages (US), the cover dimensions are as follows:

Cover length=at least 11 inches, preferred being 11.5 inches (with edge margins).

Cover width$_{minimum}$=at least 8.92 inches, preferred being at least 9.17 inches (with edge margin).

Tape length=11 inches

Tape width$_{minimum}$=at least 0.47 inch

Width of tape attached to the cover=at least 0.03 inch

Width of tape overlapped onto the front page=at least 0.047 inch

EXAMPLE 2

For binding 25 standard A-4 0.127 mm, 21 cm×29.5 cm pages (OUS), the cover dimensions are as follows:

Cover length=at least 29.5 cm, preferred being 30.8 cm (with edge margins).

Cover width$_{minimum}$=at least 22.7 cm, preferred being at least 23.3 cm (with edge margin).

Tape length=29.5 cm.

Tape width$_{minimum}$=at least 1.2 cm.

Width of tape attached to the cover=at least 0.8 mm.

Width of tape overlapped onto the front page=at least 1.2 mm.

Figure 4:
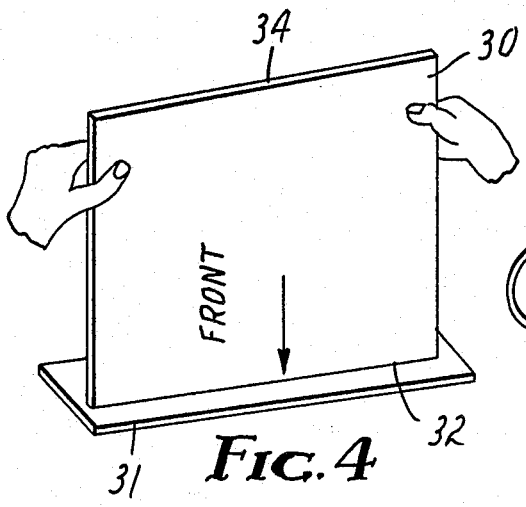
FIG. 4 is a diagrammatic perspective view of a step in the binding process.

In binding a plurality of loose sheets 30 the same are bound by placing the loose pages in a stack, removing the release liner 17 from the free portion of the binding tape strip 15, standing up the loose pages and jogging them against a flat surface 31 along a longitudinal edge 32 (front left edge) as shown in FIG. 4. The longitudinal edge 34 opposite the jogged edge 32 is then clamped by the fingers (or an optional clamp). The pages are rolled back upon themselves, as illustrated in FIG. 5, causing the unclamped longitudinal edge 32 to become shingled, exposing a marginal edge of each sheet.

Figure 6:
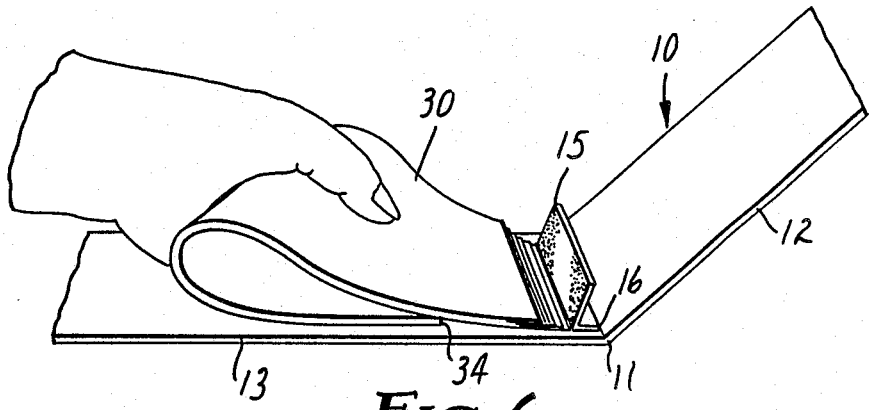
FIG. 6 is a perspective view showing a further portion of the binding process.
Figure 7:
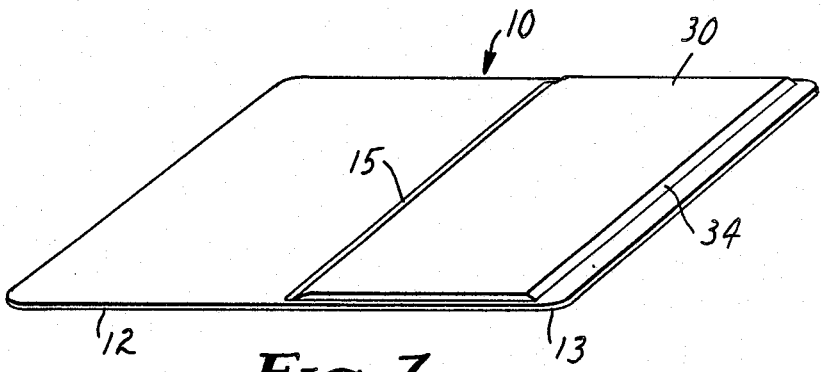
FIG. 7 is a perspective view of the bound document.

The rolled pages are then positioned in the cover 10 with the shingled edges 32 positioned along the inside of the front cover portion 13 to the line at which the tape 15 is attached, as illustrated in FIG. 6, and the tape 15 is then pressed against the shingled edges so that the binding adhesive is in contact with the shingled edges of the sheets. After the adhesive has been pressed into the shingled pages the folded sheets are released and are allowed to lay flat as shown in FIG. 7. The cover page is then exposed on the top surface of the back portion 13 and the shingled pages may be turned toward the front cover and the tape 15 flexes to allow each turned page to lay flat.

An example of a suitable adhesive tape 15 is a strip of tape having a nonwoven fibrous fabric backing carrying a continuous coating of pressures sensitive adhesive. The adhesive may comprise a normally tacky pressure-sensitive copolymer of iso-octyl acrylate and acrylic acid in 95.5:4.5 ratio. This type of adhesive is described in Ulrich's U.S. Pat. No. Re. 24,906. The adhesive has a good initial adhesion and a value of at least six (6) ounces per ½ inch or greater as measured by the Pressure Sensitive Tape Council (PSTC) "Quick Stick" test No. 5, with a minimum range of six to ten ounces per ½ inch of tape width.

Figure 8:
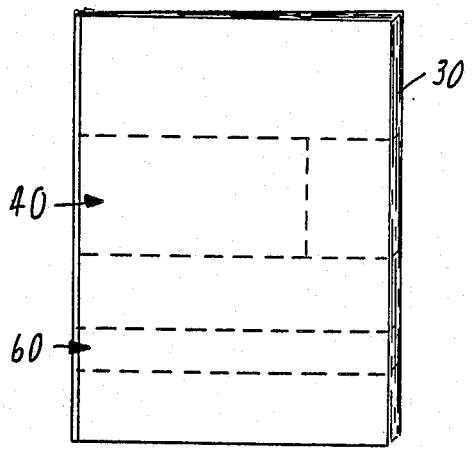
FIG. 8 is a perspective view of a document being prepared for testing.
Figure 9:
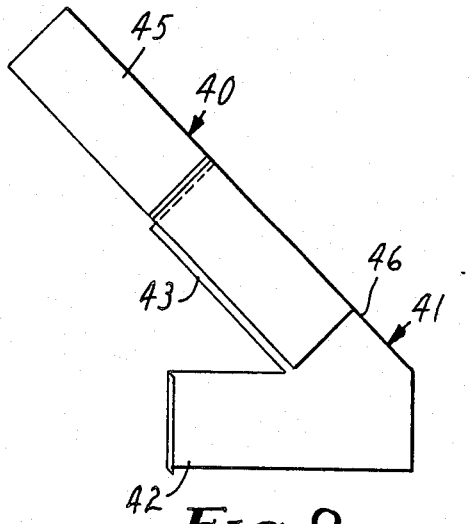
FIG. 9 is an elevational view of a fixture used for testing.
Figure 10:
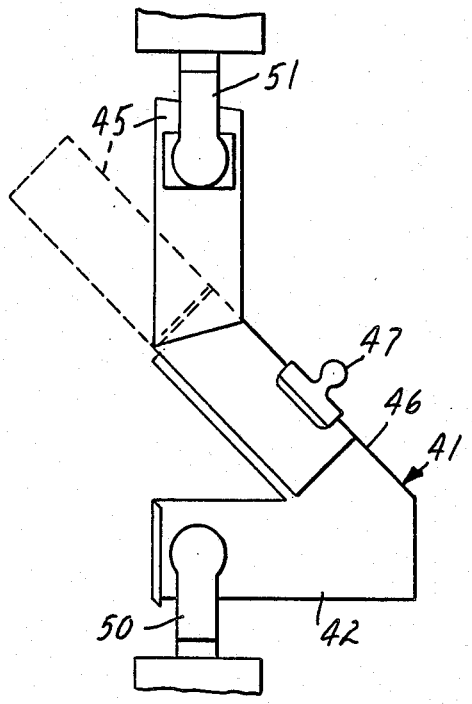
FIG. 10 is a diagrammatic view of the test fixture in a test apparatus on the 45° peel test.

A bound document can be tested to determine whether the adhesive used provided an adequate binding for the sheets. The following test was established to assess the peel strength of a page to the binding adhesive when removed at a 45° angle. Referring to FIGS. 8, 9 and 10 the test is conducted as follows using a paper cutter or guillotine the document booklet illustrated in FIG. 8 is first cut to provide a section 40 of the booklet 3 to 4 inches wide at the bound edge and 6 inches long. This cut section is then placed on a fixture 41 illustrated in FIG. 9, which fixture comprises a horizontally disposed portion 42 and an angled portion 43 disposed at 45° to the horizontally disposed portion 42. The document sample is opened to expose the third sheet 45 an the remaining pages are then clamped along the upper marginal edge 46 of the angled portion 43 by a suitable clamp 47. The horizontal portion 42 is then placed in the lower jaw 50 of an Instron tensile tester, available from Instron Corp., Canton, Mass., and the free end of the third sheet 45 is clamped in the upper jaw 51 of the Instron tensile tester. The Instron equipment is then calibrated to provide a crosshead speed of ten (10) inches per minute, the chart length set for ten (10) inches per minute, the gauge length is set to ten (10) inches, and the operator should use the Gram Cell at 1000 grams full scale. Jaw separation is then initiated as shown in FIG. 10 and the test results from the chart are recorded. Similar tests can be conducted with the sixth, ninth sheet, etc., using 20 pound Bond paper that is shingled about 0.015 inch. An acceptable average value for this test of a booklet would be at least 40 grams with at least 70 grams and above being preferred.

Figure 11:
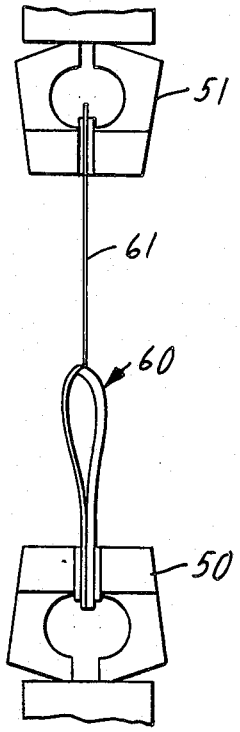
FIG. 11 is a diagrammatic view of the test apparatus on the 180° shear test.

Another test method is a 180° shear test to establish whether the adhesive has sufficient shear strength to a document page 45. This test s done on an Instron tensile tester after preparation of a booklet sample as illustrated in FIG. 8 wherein a one (1) inch wide sample 60 is cut from the finished booklet. Placing the top front cover of the sample toward the operator, the operator positions the third strip 61 from the sample in the top jaw 51 of the Instron tensile tester, see FIG. 11, and all of the remaining strips in the bottom jaw 50. Then calibrate the test equipment with a crosshead speed of 5 inches per minute, chart speed at 10 inches per minute, Gauge length at 5 inches and use the Gram Cell at 1000 grams full scale. Then initiate jaw separation and record the force to break the bond. This test can be repeated for the sixth, ninth or twelfth sheet, etc. Using 20 pound Bond paper sheets shingled 0.015 inch, acceptable values with this test are 400 grams per inch but values of 600 grams per inch and above are preferred.

Having thus described the present invention with reference to a preferred embodiment, and se modifications, it is to be realized that further modifications may be made without departing from the invention as defined in the appended claims.

We claim:

1. A backing for binding loose sheets of known length, width and thickness disposed in a stack and having inside edges that are in parallel generally uniformly spaced relationship to expose from overlying sheets in the stack narrow side surface portions of the sheets adjacent said inside edges, said backing comprising a folded flexible cover sheet of cover stock having a fold line dividing said cover sheet into a front portion and a back portion, said back portion having a length not less than the corresponding size of the sheets to be bound and width not less than the width of the sheets to be bound plus an additional marginal space, and a longitudinal pressure-sensitive adhesive tape strip having opposite continuous longitudinal edges attached along less than one-half its width to said front portion of the cover sheet adjacent the said fold line, the unattached portion of said adhesive tape strip overlaying said front portion and being in contact with a release material from which release material the unattached portion of said adhesive tape strip may be removed and adhered over the narrow side surface portions the backing.

2. A backing according to claim 1 wherein said tape has a flexural rigidity of between 0.0001 and 0.002 inch-pounds.

3. A backing according to claim 1 comprising a paper cover stock having a caliper of about 0.009 inch and a 20×26 ream weight of 80 pounds.

4. A backing according to claim 1 wherein both of the cover sheet portions have a length greater than the length of the sheets to be bound to provide for the side surface portions of the sheets to which the unattached portion to the adhesive tape strip may be adhered.

5. A backing according to claim 1 wherein the adhesive tape strip has a minimum width (w) set by a formula as follows:

$$w=\pi t(N_{max.}+5)$$

wherein t=sheet thickness, $N_{max.}$=maximum number of sheets to be bound.

6. A backing according to claim 5 wherein a tab is adhered along the longitudinal edge of said tape strip opposite said edge attached to said front portion of said sheet of cover stock and is disposed between said adhesive tape strip and said release material.

7. A backing according to claim 1 wherein said adhesive has a minimum adhesion Quick Stick value of 6 ounces per 0.5 inch of tape width and a preferred minimum value of 10 ounces per 0.5 inch of tape width.

8. A backing according to claim 7 wherein said adhesive has a 180° shear value of at least 400 grams to 600 grams per inch and 45° peel values of at least 40 grams to 70 grams.

9. A backing according to claim 1 wherein the adhesive on said tape is a normally tacky pressure-sensitive copolymer of iso-cotyl acrylate/acrylate acid in a ratio of 95.5:4.5.

10. A backing according to claim 1 wherein a second strip of adhesive tape is aligned with said first mentioned strip of tape, said second strip of tape having liner covering a portion thereof and having a portion attached to said first mentioned strip opposite the portion attached to said cover portion.

11. A method of binding loose pages of paper of known length, width and thickness, said method comprising the steps of:

selecting a cover having a size to cover the pages to be bound and having a strip of pressure sensitive adhesive tape adhered along one edge adjacent to the central fold line thereof, removing a release liner from the pressure-sensitive tape, jogging the pages to be bound against a flat surface along the front left longitudinal edge, clamping the pages together along the opposite longitudinal edge, rolling the pages forward upon themselves, causing the unclamped longitudinal edges of the pages to become shingled, sliding the rolled pages along the inside of the cover up to the central fold line and beneath the free longitudinal edge of the tape, and pressing the tape into contact with the shingled edges of the pages.

* * * * *

UNITED STATES PATENT AND TRADEMARK OFFICE

CERTIFICATE OF CORRECTION

PATENT NO. : 4,793,758

DATED : December 27, 1988

INVENTOR(S) : Gary R. Hanson, et al

It is certified that error appears in the above-identified patent and that said Letters Patent is hereby corrected as shown below:

In Figure 3, " ' " should be added to reference numerals 11, 12, 15, 16 and 17.

Col. 1, line 34, "sheet" should be --sheets--.

Col. 2, line 19, "covers" should be --cover,--.

Col. 2, line 44, before "pounds" insert --80--.

Col. 3, line 33 after "onto" insert --the front page of--.

Col. 5, line 26, change "an" to --and--.

Col. 5, line 65, change "se" to --several--.

Claim 1, Col. 6, line 12, after "and" insert --a--.

Claim 1, Col. 6, line 23, after "portions" insert --and inside edges of the sheets to adhere the sheets into--.

Claim 9, Col. 6, line 58, change "iso-cotyl acrylate/acrylate" to --iso-octyl acrylate/acrylic--.

Signed and Sealed this

Twenty-ninth Day of January, 1991

*Attest:*

HARRY F. MANBECK, JR.

*Attesting Officer*

*Commissioner of Patents and Trademarks*